US005508148A

United States Patent [19]

Lau et al.

[11] Patent Number: 5,508,148

[45] Date of Patent: Apr. 16, 1996

[54] PHOTOGRAPHIC ELEMENT CONTAINING A NOVEL CYAN DYE FORMING COUPLER AND PROCESS FOR ITS USE

[75] Inventors: Philip T. S. Lau; Thomas H. Jozefiak, both of Rochester; Thomas R. Welter, Webster, all of N.Y.

[73] Assignee: Eastman Kodak Company, Rochester, N.Y.

[21] Appl. No.: 359,137

[22] Filed: Dec. 19, 1994

[51] Int. Cl.[6] ..... G03C 7/34

[52] U.S. Cl. ..... 430/384; 430/385; 430/552; 430/553

[58] Field of Search ..... 430/552, 553, 430/384, 385

[56] References Cited

U.S. PATENT DOCUMENTS

| | | | |
|---|---|---|---|
| 3,079,256 | 2/1963 | Van Poucke | 430/553 |
| 3,556,796 | 1/1971 | Vanden Eynde | 430/553 |
| 3,591,384 | 7/1971 | Guzzi et al. | 430/553 |
| 4,208,210 | 6/1980 | Sakai et al. | 430/180 |
| 4,725,530 | 2/1988 | Kobayashi et al. | 430/505 |
| 4,833,069 | 5/1989 | Hamada et al. | 430/496 |
| 4,857,442 | 8/1989 | Fujita et al. | 430/393 |
| 4,883,746 | 11/1989 | Shimada et al. | 430/504 |
| 4,957,853 | 9/1990 | Kobayashi et al. | 430/553 |
| 4,983,503 | 1/1991 | Ishikawa et al. | 430/393 |

FOREIGN PATENT DOCUMENTS

| | | | |
|---|---|---|---|
| 250201 | 3/1987 | European Pat. Off. | 430/552 |
| 1463064 | 12/1966 | France | 430/553 |
| 48-057961 | 1/1973 | Japan . | |
| 48-059838 | 10/1973 | Japan . | |
| 63-187239 | 5/1988 | Japan . | |
| 01185630 | 4/1989 | Japan . | |

OTHER PUBLICATIONS

Research Disclosure 29015, Jun. 1988, Disclosed Anonymously.

*Primary Examiner*—Lee C. Wright
*Attorney, Agent, or Firm*—Arthur E. Kluegel

[57] ABSTRACT

A photographic element comprises a light sensitive silver halide emulsion layer having associated therewith a cyan dye-forming coupler dispersed in an organic solvent, the coupler having the formula:

wherein

A, B, and C are hydrogen or fluoride;

X is selected from the group consisting of halogen, alkoxy and methyl groups;

R is an aromatic or aliphatic group and n is 1 or 2;

R' is a substituent group and m is from 0 to 4;

COG is hydrogen or a coupling-off group capable of being split-off by an oxidized color developer; and wherein the substituent groups X, R, and R' are selected so as to ballast the coupler and keep it from wandering within the photographic elements.

12 Claims, No Drawings

PHOTOGRAPHIC ELEMENT CONTAINING A NOVEL CYAN DYE FORMING COUPLER AND PROCESS FOR ITS USE

FIELD OF INVENTION

The present invention relates to a photographic silver halide material Containing a cyan dye forming coupler with improved photographic properties and to a process for its use.

BACKGROUND OF INVENTION

A typical photographic element contains multiple layers of light-sensitive photographic silver halide emulsions with one or more of these layers being spectrally sensitized to blue light, green light, or red light. The blue, green, and red light sensitive layers will typically contain yellow, magenta or cyan dye forming couplers, respectively.

For forming color photographic images, the color photographic material is exposed imagewise and processed in a color developer bath containing an aromatic primary amine color developing agent. Image dyes are formed by the coupling reaction of these couplers with the oxidized product of the color developing agent. Generally, image couplers are selected to provide image dyes with good stability towards heat and light and which desirably have low unwanted side absorptions in order to provide color photographic images with good color reproduction.

The couplers used to produce cyan image dyes are generally derived from phenols and naphthols, as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,880,661, 3,996,253, 3,758,308, in French patents 1,478,188 and 1,479,043, and in British patent 2,070,000. These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in photographic film and paper products, the dyes derived from them still suffer from undesirable side absorptions, causing considerable reduction in color reproduction.

Cyan couplers which have been so far proposed to overcome this problem are nitrogen containing heterocyclic couplers as disclosed in U.S. Pat. Nos. 4,728,598, 4,818,672, 4,873,183, 4,916,051, 5,118,812, 5,206,129, and EP patent 249,453A. Even though cyan dyes produced by these couplers show a reduction in their undesirable side absorptions, these couplers exhibit undesirably low coupling activity. Furthermore, the dyes derived from them have very low stability against heat, light, and have a very short absorption peak (λ-max). These disclosed novel couplers are therefore not practical for use in photographic products.

Other cyan couplers proposed for improving color reproduction are disclosed in U.S. Pat. Nos. 3,552,962, 3,839,044, 4,960,685, and German patent publications DE 3,005,355 and 3,022,915. All these couplers are based on a well known coupler parent disclosed in U.S. Pat. No. 3,002,836 that is currently used in photographic color film products (see formula I). However, to use these couplers as incorporated couplers in the silver halide emulsion layers, and to achieve the same sharp-cutting dye hue as provided by coupler represented by formula (I), these couplers must by necessity be ballasted in the aryloxy coupling-off groups or be anchored to a suitable polymeric backbone as illustrated by formula (II).

(I)

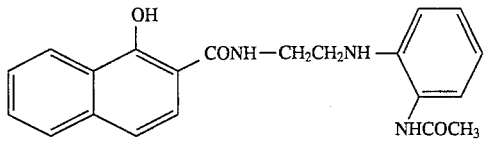

(II)

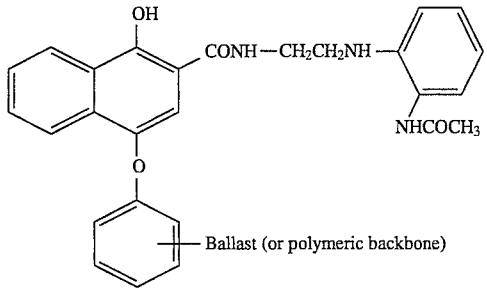

While these latter couplers will form the same dye as those provided by formula (I), their color reproducibility is highly variable and highly dependent on the type and nature of the coupling-off groups, which, because of the ballasts, are not readily washed out of the photographic layers during processing.

In addition to the forgoing, many naphtholic couplers have been notorious for their susceptibility to leuco dye formation in the presence of ferrous ion. Ferrous ion is generated in the bleach or bleach/fix bath as a result of the reduction of ferric ion during the bleaching process. The ferrous ion may than react with the naphtholic dye to eliminate the nitrogen double bond rendering the dye colorless. This manifests itself as a loss in dye density.

It is a problem to be solved to provide a photographic element containing a cyan coupled which exhibits excellent photographic properties such as reduced side absorptions of the formed dye, particularly on the short wavelength side of the spectrum, and improved stability towards ferrous ion reduction in the processing bleach or bleach-fix bath.

SUMMARY OF THE INVENTION

The invention provides a photographic element which comprises a light sensitive silver halide emulsion layer having associated therewith a cyan dye-forming coupler dispersed in an organic solvent, the coupler having the formula:

(III)

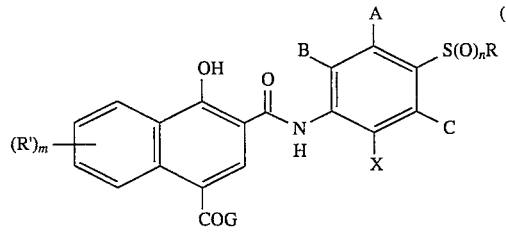

wherein

A, B, and C are hydrogen or fluoride;

X is selected from the group consisting of halogen, alkoxy and methyl groups;

R is an aromatic or aliphatic group and n is 1 or 2;

R' is a substituent group and m is from 0 to 4;

COG is hydrogen or a coupling-off group capable of being split-off by an oxidized color developer; and wherein the substituent groups X, R, and R' are selected so as to ballast the coupler and keep it from wandering within the photographic elements.

The invention also provides a process for forming an image employing the described element.

A photographic element of the invention exhibits excellent photographic properties such as reduced side absorptions of the formed dye, particularly on the short wavelength side of the spectrum, and improved stability towards ferrous ion reduction in the processing bleach or bleach-fix bath.

DETAILED DESCRIPTION OF THE INVENTION

In the above formula (III), COG represents a hydrogen atom or a group which can be split off by the reaction of the coupler with an oxidized color developing agent. Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference. Hydrogen, alkoxy and aryloxy groups are most suitable.

Examples of specific coupling-off groups are Cl, F, Br, —SCN, —$OCH_3$, —$OC_6H_5$, —$OCH_2C(=O)NHCH_2CH_2OH$, —$OCH_2C(=O)NHCH_2CH_2OCH_3$, —$OCH_2C(=O)NHCH_2CH_2OC(=O)OCH_3$, —$NHSO_2CH_3$, —$OC(=O)C_6H_5$, —$NHC(=O)C_6H_5$, —$OSO_2CH_3$, —$P(=O)(OC_2H5)_2$, —$S(CH_2)_2CO_2H$.

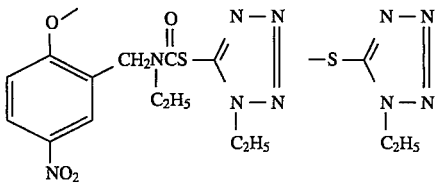

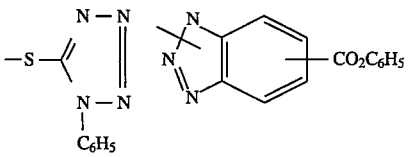

-continued

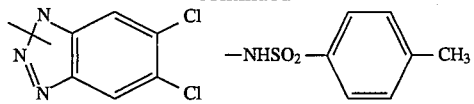

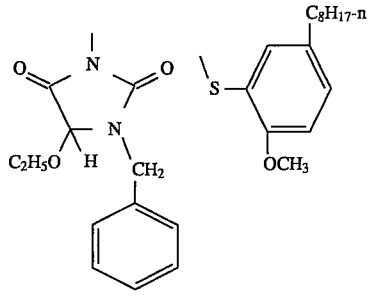

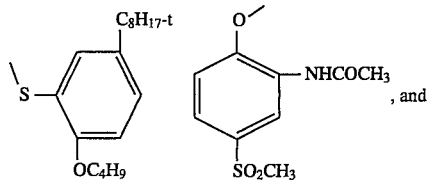

, and

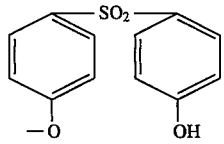

Preferably, the COG is H, halogen or aryloxy, and more preferably, H, Cl or p-acetamide phenoxy.

In formula (III), R represents any aliphatic or aromatic substituent group. The "aliphatic" group as referred to herein indicates, for example, a linear, branched, or cyclic hydrocarbon group which may be substituted or unsubstituted, and may be saturated or unsaturated such as methyl, ethyl, dodecyl, octadecyl, etc. The term "aromatic" group indicates, for example, a phenyl, naphthyl, or heterocycle ring which may be substituted or unsubstituted or other group which contains an aromatic nucleus. Suitably, R contains up to 48 carbon atoms, preferably up to 30 carbon atoms.

In formula (III), each R', when present, is independently a substituent group used to optimize the performance of the couplers such as coupling efficiency, coupler solubility, diffusion resistance, dye hue, or dye stability to light, heat, and moisture. Suitably, R' may represent a substituent such as a cyano group, a halogen atom, an alkyl group (e.g., methyl, propyl, hexadecyl), an alkoxy group (e.g., methoxy, ethoxy, tetradecyloxy), an aryloxy group (e.g., phenoxy, 4-t-butylphenoxy, 4-dodecyl-phenoxy), an aliphatic or aromatic acyloxy group (e.g., acetoxy, dodecanoyloxy), an aliphatic or aromatic acylamino group (e.g., acetamido, benzamido, hexadecanamido), an aliphatic or aromatic sulfonyloxy group (e.g., methylsulfonyloxy, dodecylsulfonyloxy, 4-methoxyphenylsulfonyloxy), an aliphatic or aromatic sulfamoylamino group (e.g., N-butylsulfamoylamino, N-4 -t-butylphenylsulfamoylamino), an aliphatic or aromatic sulfonamido group (e.g., methanesulfonamido, p-toluenesulfonamido, hexadecane-sulfonamido), an ureido group (e.g., methylureido, phenylureido), an alkoxycarbonyl or aryloxycarbonyl group (e.g., methoxycarbonyl, octadecyloxycarbonyl, 3-pentadecyloxyphenylcarbonyl), an alkoxycarbonylamino or aryloxycarbonylamino group (e.g., methoxycarbonylamino, phenoxycarbonylamino), a carbamoyl group (e.g., N-butylcarbamoyl, N-methyl-N-dodecylcarbamoyl), a fluoroalkyl group (e.g., trifluoromethyl, heptafluoropropyl).

In the formula (III), m is an integer of 0 to 4, suitably 1 or 2, and n is an integer of 1 or 2.

The ortho substituent, X, must be carefully selected to provide a coupler which will form a dye having the desired properties. In particular, X may be selected from halogen, methyl, and alkoxy substituent groups. As the subsequent data shows, if there is not an ortho substituent meeting the requirement for X, the desired dye properties are not obtained.

In formula (III), A, B, and C may be hydrogen atoms or fluoride atoms. The comparative data provided herein indicates that other substituents in these locations destroy the desirable hue effects of the invention.

It is essential that the substituent groups X, R, and R' be selected so as to ballast the coupler and resulting dye in the organic solvent in which it is dispersed. The ballasting may be accomplished by providing hydrophobic substituent groups in one or more of these substituent groups. Generally, a ballast group is an organic radical of such size and configuration as to confer on the coupler molecule sufficient bulk as to render the coupler substantially nondiffusible from the layer in which it is coated in a photographic element. Thus the combinations of substituent groups X, R, and R' from the formula are suitably chosen to meet these criteria. To be effective, the ballast must contain at least 10–30 carbon atoms, and may suitably be located in substituent R or R' of the formula.

The chief advantage of building the ballast into the coupler parent molecule instead of the aryloxy coupling-off group is reliable color reproducibility. The dye absorption characteristics are not changed or affected by the nature of the coupling-off groups, the coupler solvents used in the coatings, or the color developers employed in the processing baths.

Another important advantage of having the ballast in the coupler parent molecule is the ability of the present invention to provide both 2- and 4-equivalent couplers for specific product applications. Other advantages are shown by their excellent coupling efficiency, coupler solubility, and dispersability.

The following examples further illustrate the invention. It is not to be construed that the present invention is limited to these examples.

M-1

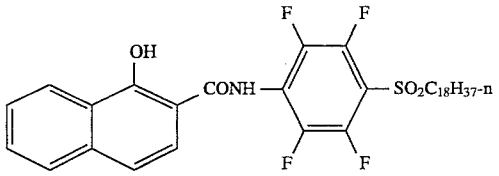

M-2

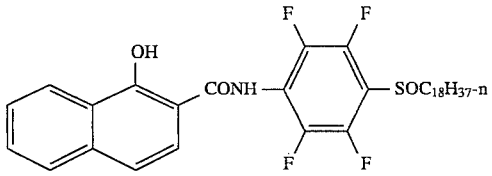

M-3

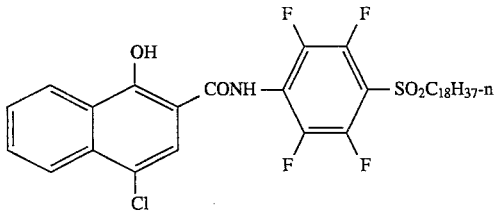

M-4

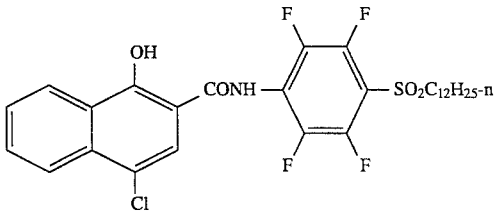

M-5

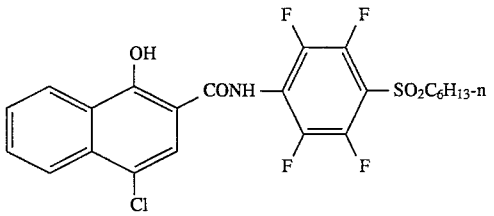

M-6

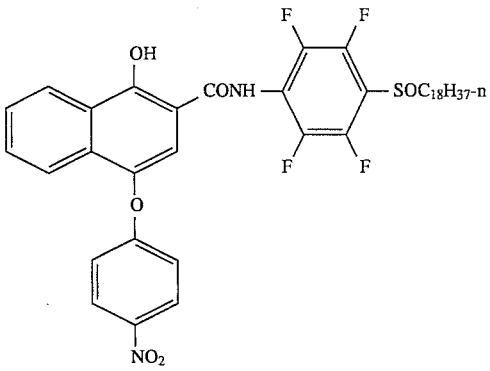

-continued
M-7
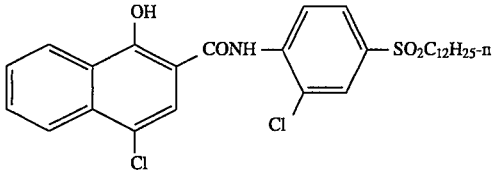
M-8
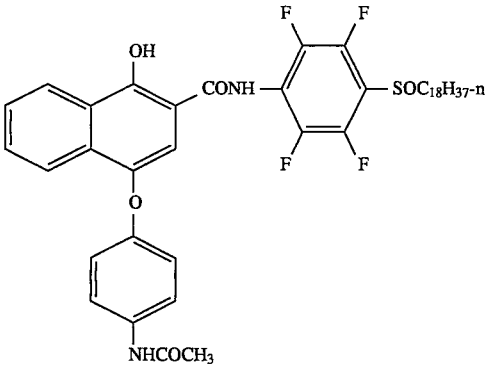
M-9
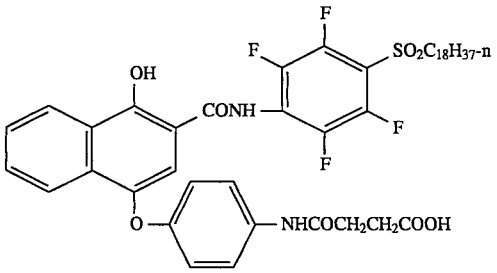
M-10
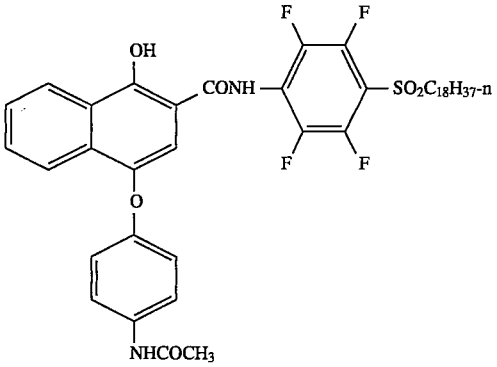
M-11
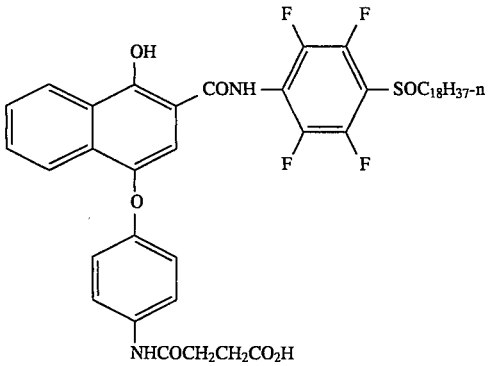
M-12
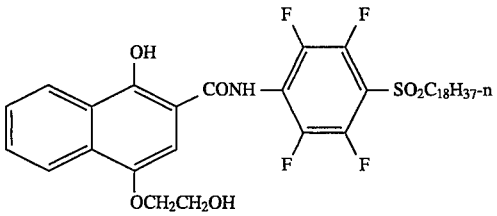
M-13
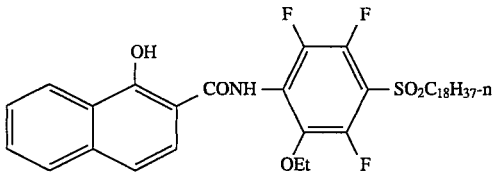
M-14
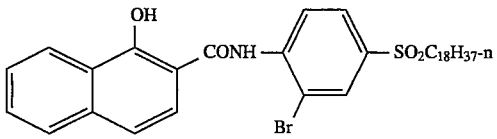
M-15
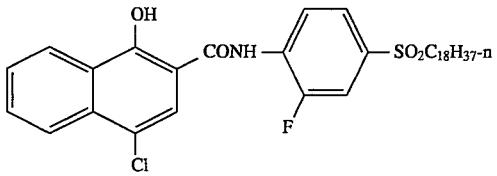
M-16
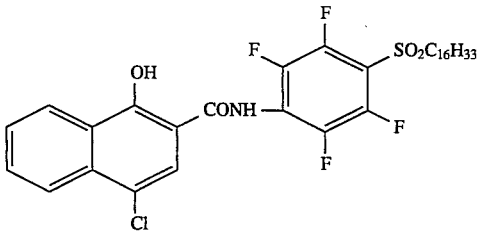

-continued
M-17
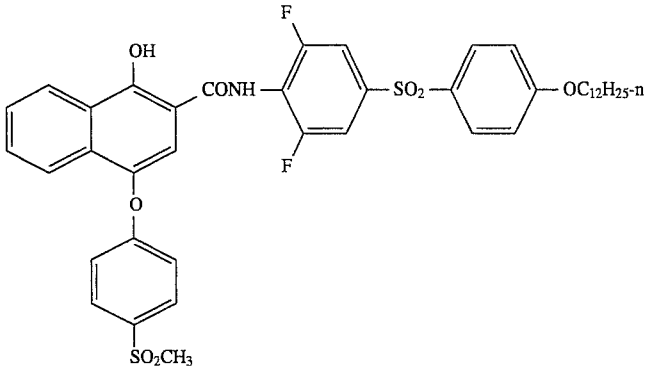
M-18
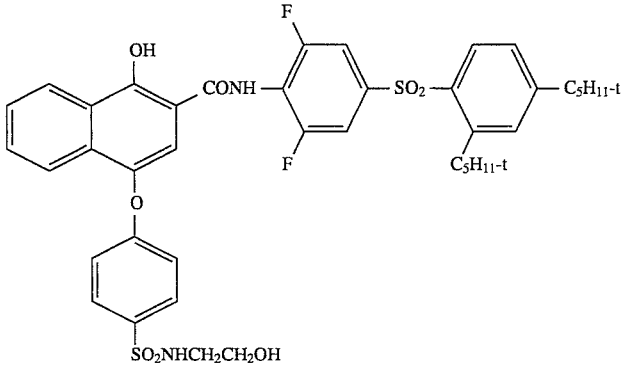
M-19
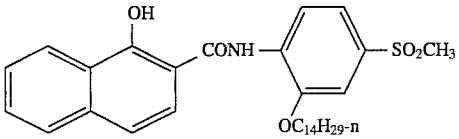
M-20
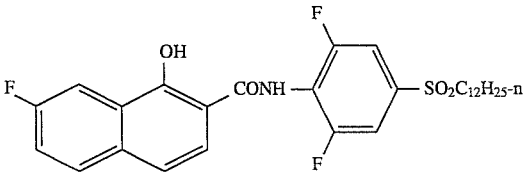
M-21
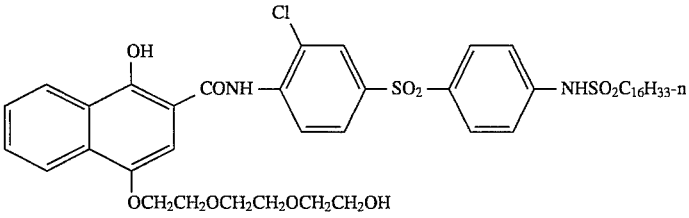
M-22
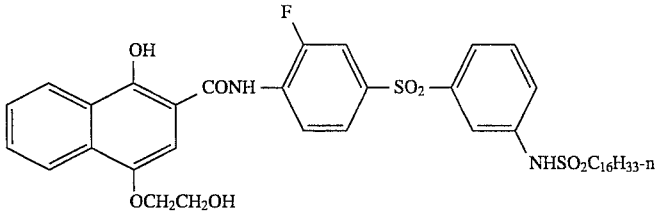
M-23
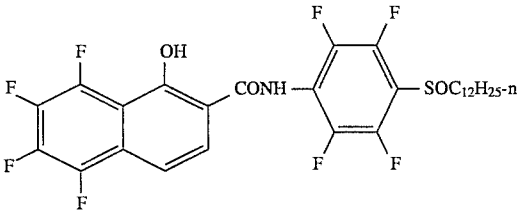
M-24
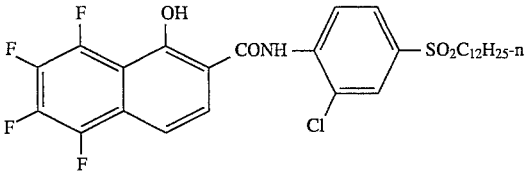

-continued
M-25
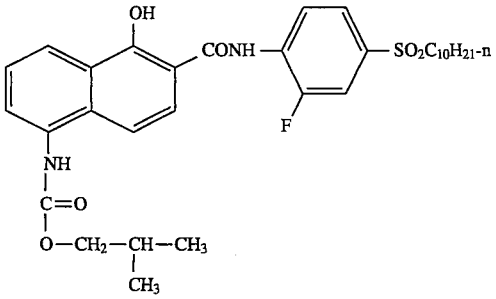
M-26
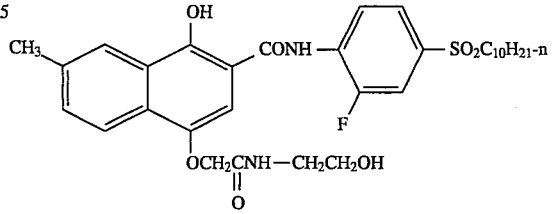
M-27
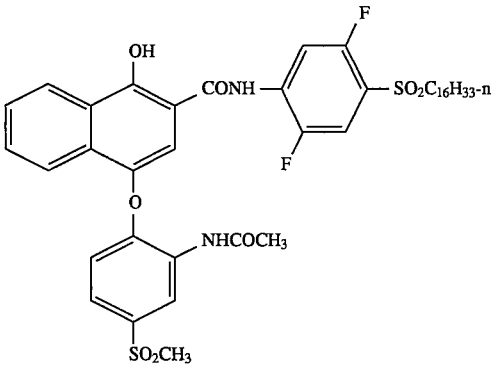
M-28
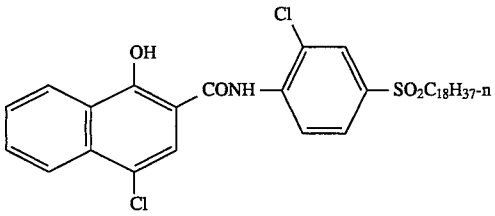
M-29
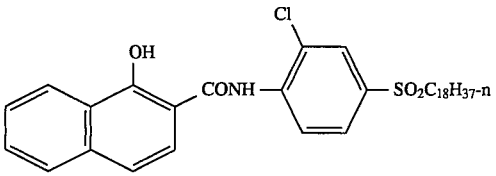
M-30
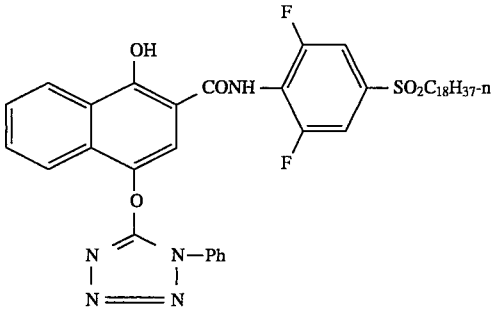
M-31
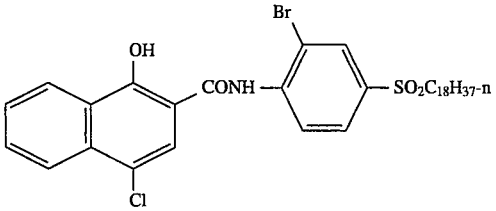
M-32
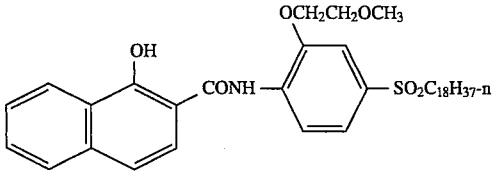
M-33
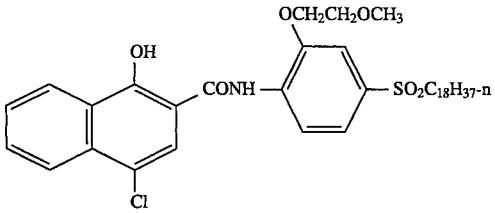
M-34
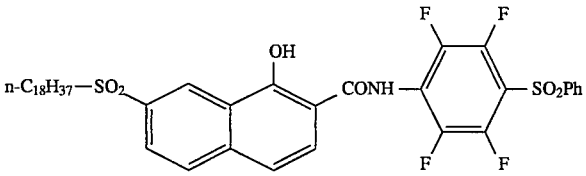

-continued

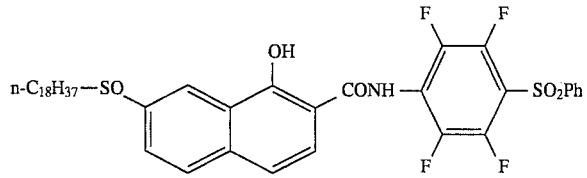

M-35

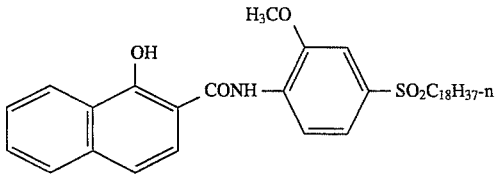

M-36

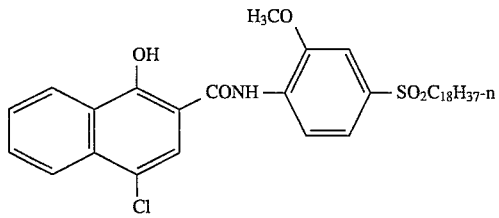

M-37

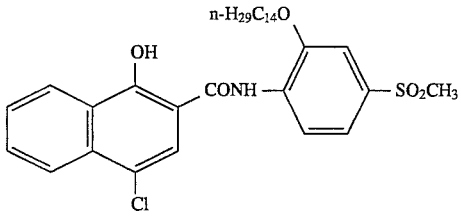

M-38

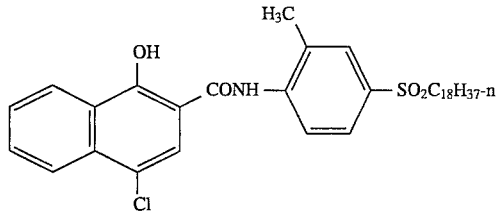

M-39

Unless otherwise specifically stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5 -tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N' -ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl] carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference.

In the following discussion of suitable materials for use in the emulsions and elements of this invention, reference will be made to *Research Disclosure,* September 1994, Item 36544, available as described above, which will be identified hereafter by the term "Research Disclosure" The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and Vi through VIII. Color materials are described in Sections X through XIII. Scan facilitating is described in Section XIV. Supports, exposure, development systems, and processing methods and agents are described in Sections XV to XX.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-(( 2-(4-ethoxy-2,5-dioxo-3-(phenylmethyl)-1 -imidazolidinyl)-3-(4-methoxyphenyl)-1,3 -dioxopropyl)amino)-, dodecyl ester and a slow yellow layer containing the same compound together with "Coupler 2": Propanoic acid, 2-[[5-[[4-[2-[[[2,4-bis( 1,1-dimethylpropyl)phenoxy]acetyl]amino]-5-[ (2,2,3,3,4,4,4-heptafluoro-1-oxobutyl)amino]-4-hydroxyphenoxy] -2,3-dihydroxy-6-[(propylamino)carbonyl phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl) 1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis( 1,1-dimethylpropyl)phenoxy)-1-oxobutyl)amino)-N-( 4,5-dihydro-5-oxo-1-(2,4,6-trichlorophenyl)-1H-pyrazol- 3-yl)-, "Coupler 5": Benzamide, 3-((2-(2,4-bis( 1,1-dimethylpropyl)phenoxy)-1-oxobutyl)amino)-N-( 4',5'-dihydro-5'-oxo-1'-(2,4,6-trichlorophenyl) (1,4'-bi-1H-pyrazol)-3'-yl)-, "Coupler 6": Carbamic acid, (6-((( 3-(dodecyloxy)propyl) amino)carbonyl)-5-hydroxy-1 -naphthalenyl)-, 2-methylpropyl ester , "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol- 3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6 -trichlorophenyl)-4,5-dihydro-5-oxo-1H-pyrazol-3-yl]-2 -methyl-2-propenamide; and "Coupler 10": Tetradecanamide, N-(4-chloro-3-((4-((4-((2,2-dimethyl-1-oxopropyl) amino)phenyl)azo)-4,5-dihydro-5-oxo-1-( 2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy- 1-naphthalenyl) oxy)ethoxy)phenyl)azo)-4 -hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-( 3,5-dichloro-2-hydroxy-4-methylphenyl)-, "Coupler 2". Acetamide, 2-(2,4-bis(1,1-dimethylpropyl)phenoxy)-N-( 3,5-dichloro-2 -hydroxy-4-, and UV Stabilizers: Phenol, 2-(5-chloro-2H-benzotriazol-2-yl)-4,6-bis(1,1 -dimethylethyl)-; Phenol, 2-(2H-benzotriazol-2-yl)-4-( 1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[ 2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1 -dimethylpropyl)phenoxy)-1-oxobutyl)amino)-2 -chlorophenyl)-.alpha.-(2,2-dimethyl-1-oxopropyl)-4 -ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-( 1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[ [2-[4-ethoxy-2,5-dioxo-3-(phenylmethyl)-1-imidazolidinyl] -4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5 -dichlorophenyl)-4,5-dihydro-5-oxo-1H-pyrazol-3-yl]-2 -methyl-2-propenamide; "Coupler 4": Benzamide, 3-((2-( 2,4-bis(1,1-dimethylpropyl)phenoxy)-1-oxobutyl)amino)-N-( 4,5-dihydro-5-oxo-1-(2,4,6-trichlorophenyl)-1H-pyrazol- 3-yl)-; and "Coupler 5": Benzamide, 3-(((2,4-bis( 1,1-dimethylpropyl)phenoxy)acetyl)amino)-N-(4,5 -dihydro-5-oxo-1-(2,4,6-trichlorophenyl)-1H-pyrazol-3 -yl)-; and containing the stabilizer 1,1'-Spirobi(1H-indene), 2,2',3,3'-tetrahydro-3,3,3',3'-tetramethyl- 5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2 -cyanophenoxy)-N-(4-((2,2,3,3,4,4,4-heptafluoro-1 -oxobutyl)amino)-3-hydroxyphenyl)-; a mid cyan containing "Coupler 7": Butanamide, N-(4-((2-(2,4-bis( 1,1-dimethylpropyl)phenoxy)-1-oxobutyl)amino)-2 -hydroxyphenyl)-2,2,3,3,4,4,4-heptafluoro- and "Coupler 8": Hexanamide, 2-(2,4-bis(1,1-dimethylpropyl)phenoxy)-N-( 4-((2,2,3,3,4,4,4-heptafluoro-1-oxobutyl)amino)-3 -hydroxyphenyl)-; and a slow cyan layer containing Couplers 6, 7, and 8;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

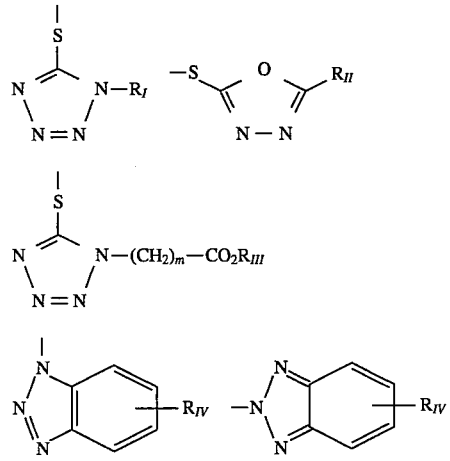

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60- 249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

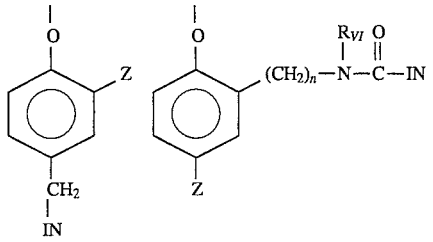

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

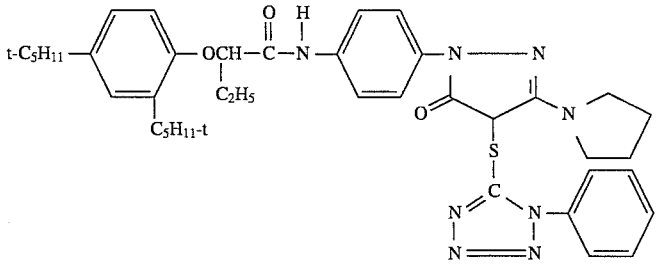

D2

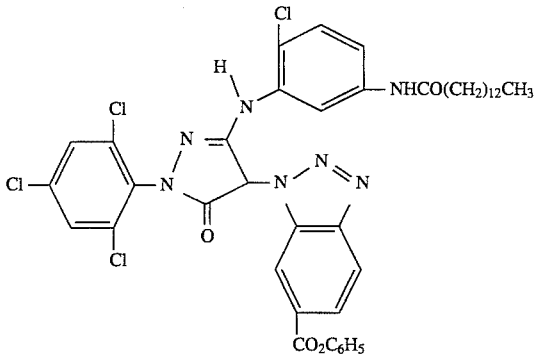

D3

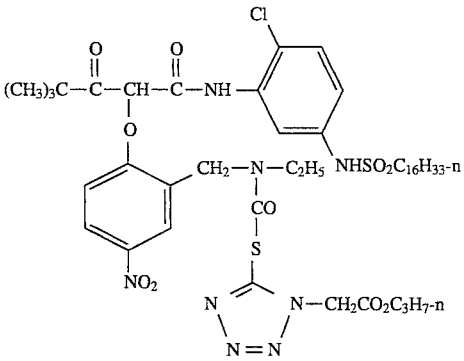

D4

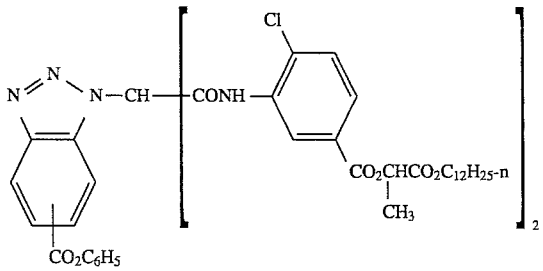

D5

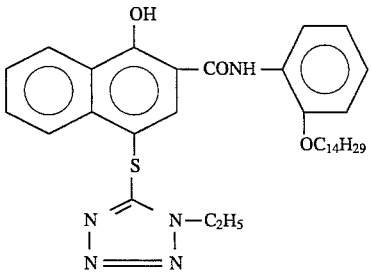

-continued

D6

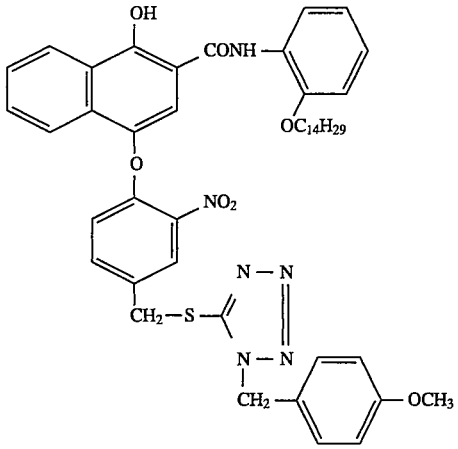

D7

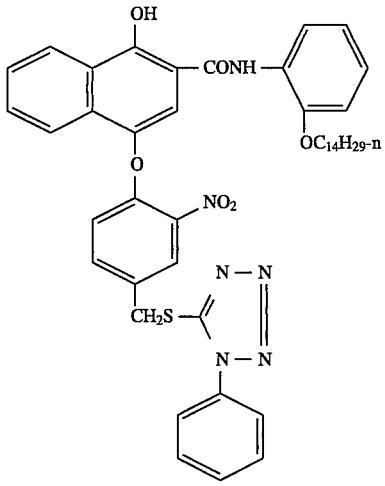

D8

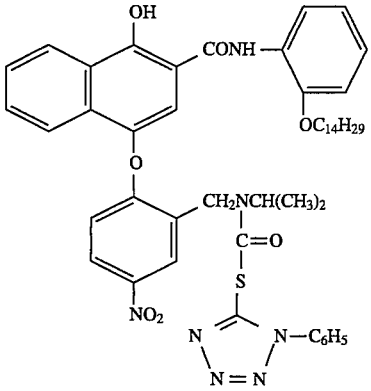

D9

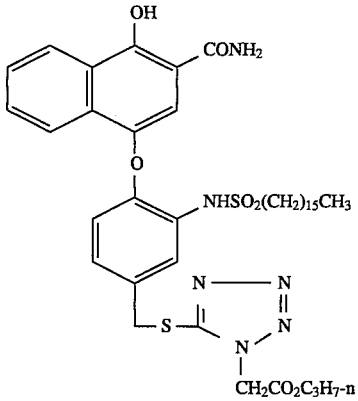

D10

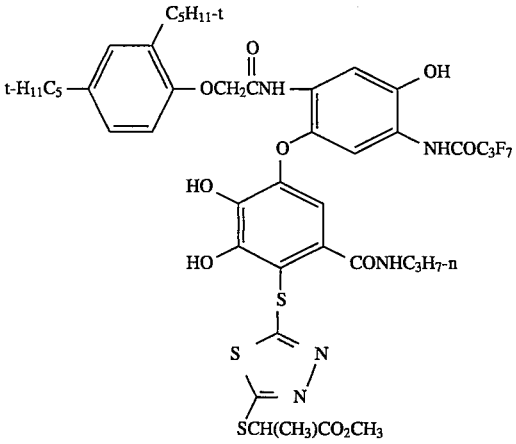

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90- 072,632; 90-072, 633; 90-072,634; 90-077,822; 90- 078,229; 90-078,230; 90-079,336; 90-079,337; 90- 079,338; 90-079,690; 90-079, 691; 90-080,487; 90- 080,488; 90-080,489; 90-080,490; 90-080,491; 90- 080,492; 90-080,494; 90-085,928; 90-086, 669; 90- 086,670; 90-087,360; 90-087,361; 90-087,362; 90-087,363; 90-087,364; 90-088,097; 90-093,662; 90- 093,663; 90-093,664; 90-093,665; 90-093,666; 90- 093,668; 90-094, 055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198– 199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS

The couplers of the present invention can be prepared as follows:

Scheme

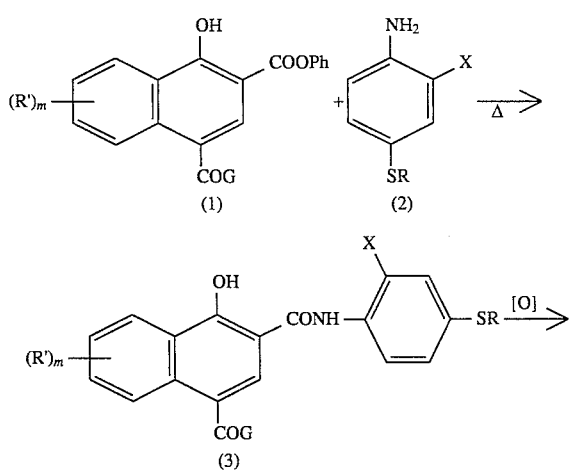

-continued

Scheme

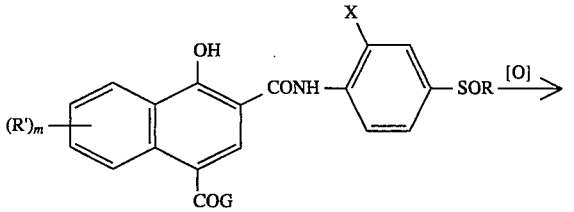

(4)

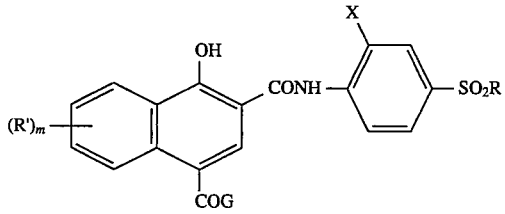

(5)

As an alternative scheme for the production of the sulfone or sulfonyl phenyl 1-hydroxynaphthoate compounds, the starting sulfonyl materials may be heated with the 1-hydroxy naphthoate in the presence of air until the reaction is complete.

The synthesis of couplers of the present invention can be further illustrated by the specific preparation of couplers M-1, M-2, and M-7.

Preparation of Coupler M-1

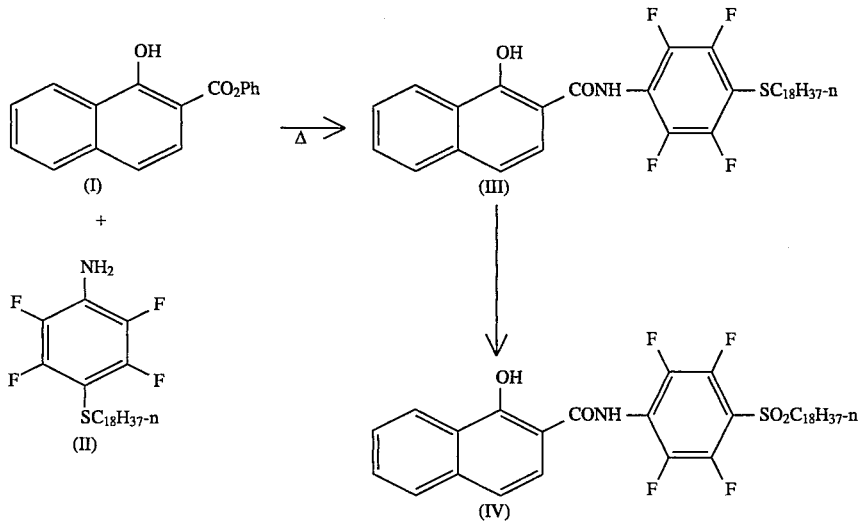

A mixture of 6.5 g (0.025 mol) of (I) and 11.0 g (0.025 mol) of (II) in 50 mL of 1,2,4-trichlorobenzene was heated with stirring in an oil-bath at 200° C. for 2–5 hr. After cooling to room temperature, the mixture was diluted with 100 mL of heptane. The solid which precipitated out was collected, washed with heptane, and recrystallized from $CH_3CN$ to give 10 g (65%) of white solid; m.p. 117°–120° C. The structure of the product (III) was consistent with its $^1H$ NMR spectrum.

Calcd. for $C_{35}H_{45}F_4NO_2S$: C, 67.8; H, 7.3; N, 2.3; Found: C, 68.2; H, 7.0; N, 2.2.

A suspension of 6.2 g (0.01 mol) of compound (III) prepared as described above, in 100 mL $CH_2Cl_2$ was heated under reflux on a steam bath until complete solution was achieved. To the refluxing solution was added with stirring 5.2 g (0.03 mol) of m-chloroperbenzoic acid in small portions. The mixture was refluxed for 3 hr until tlc (heptane-EtOAc, 1:1) showed all compound (III) had been oxidized to compound (IV). After cooling to room temperature the solid which crystallized out was collected and washed with methanol. Recrystallization from EtOAc gave 3.4 g (52%) of white crystalline solid; m.p. 147°–148° C. The structure of compound (IV) corresponding to coupler (M-1) was confirmed by its $^1H$ NMR spectrum.

Calcd. for $C_{35}H_{45}F_4NO_4S$: C, 64.50; H, 6.96; N, 2.15; Found: C. 64.31; H, 6.69; N, 2.07.

Preparation of Coupler M-2

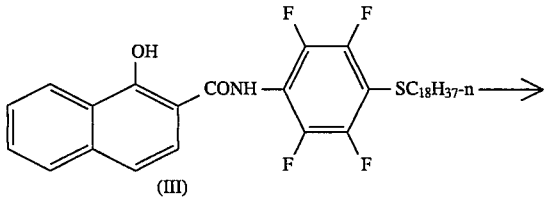

(III)

-continued

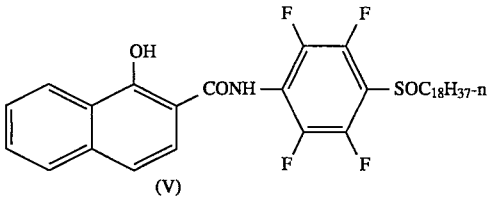

(V)

A suspension of 6.2 g (0.01 mol) of compound (III) in 100 mL $CH_2Cl_2$ was heated on a steam bath until solution was achieved. To the refluxing solution was added portionwise 1.9 g (0.01 mol) of m-chloroperbenzoic acid. The progress of the reaction was carefully followed by tlc (heptane-EtOac, 1:1). When all compound (III) had been oxidized to compound (V), the reaction was quenched with 2.0 mL of dimethylsulfide. The solvent was removed under reduced pressure, and the residue recrystallized from $CH_3CN$ to give 5.2 g (81%) of white solid; m.p. 128°–130° C. The structure of compound (V) corresponding to coupler (M-2) was confirmed by its $^1H$ NMR spectrum.

Calcd. for $C_{35}H_{45}F_4NO_3S$: C, 66.12; H, 7.13; N, 2.20; Found: C, 66.18: H, 7.12; N, 2.25.

Preparation of Coupler M-7

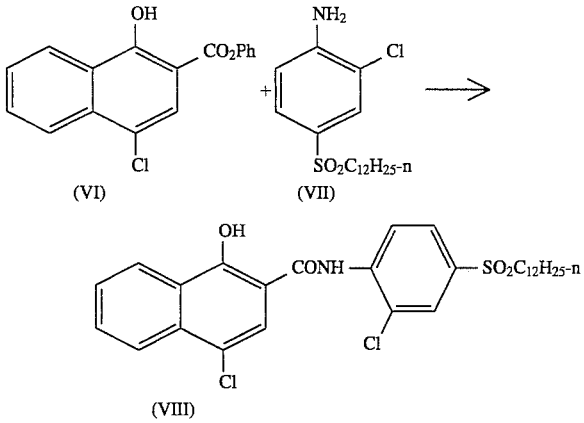

A mixture of 9.0 g (0.03 mol) of (VI) and 10.8 g (0.03 mol) of (VII) was heated with stirring in an oil-bath at 200° C. for 3 hr. The hot melt was taken up in 250 mL EtOAc and allowed to cool to room temperature. The white solid which crystallized out was collected to give 12.7 g (75%) of tlc pure (heptane-EtOAc, 1:1) product; m.p. 166°–167° C. The structure of compound (VIII) corresponding to coupler (M-7) was confirmed by its $^1H$ NMR spectrum.

Calcd. for $C_{29}H_{35}Cl_2NO_4S$: C, 61.70; H, 6.25; N, 2.48; Found: C, 61.31; H, 6.26; N, 2.41.

Other compounds of the present invention can be prepared in the same manner as described above.

PHOTOGRAPHIC EXAMPLES

The following are comparison compounds tested as couplers in the photographic examples:

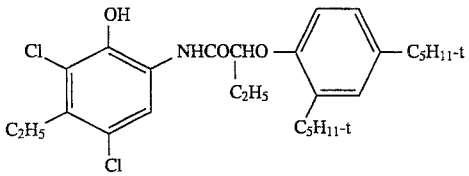

C-1

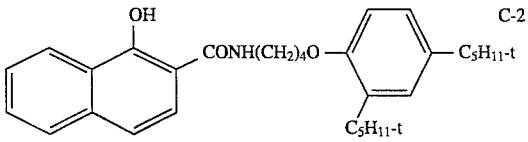

C-2

-continued

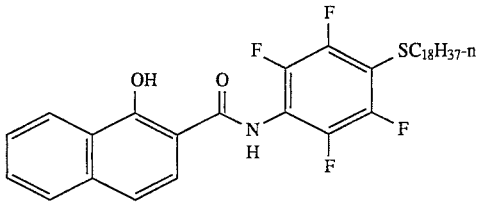

C-3

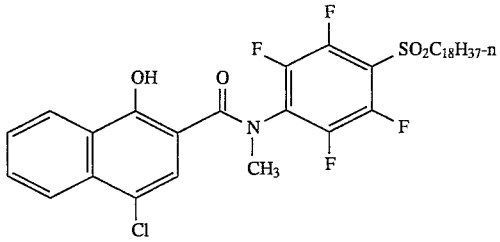

C-4

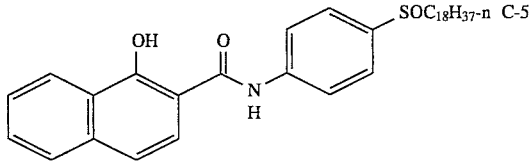

C-5

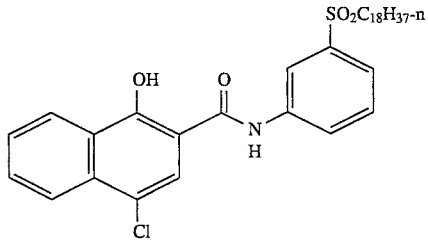

C-6

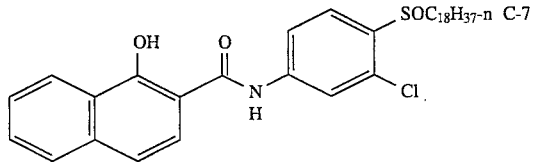

C-7

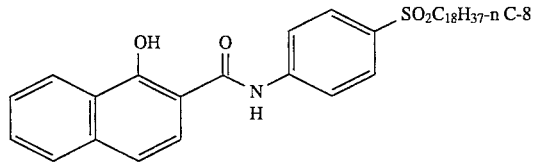

C-8

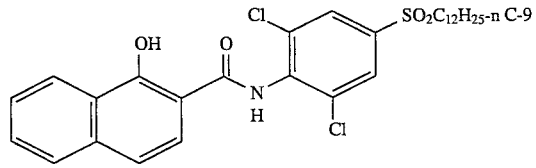

C-9

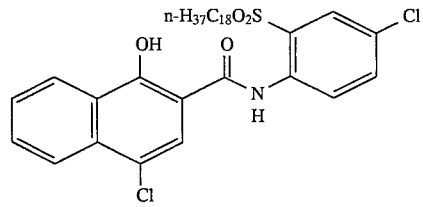

C-10

-continued

C-11

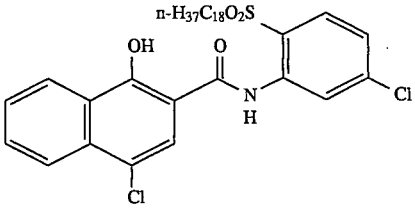

C-12

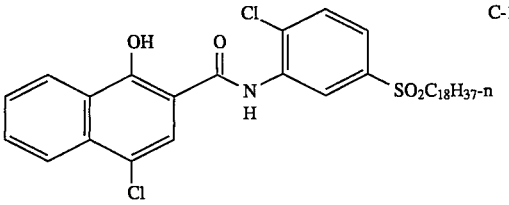

C-13

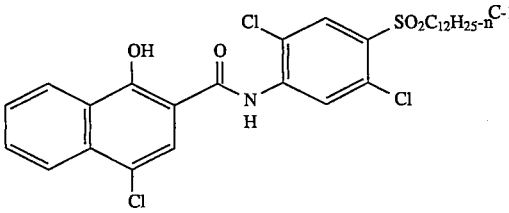

C-14

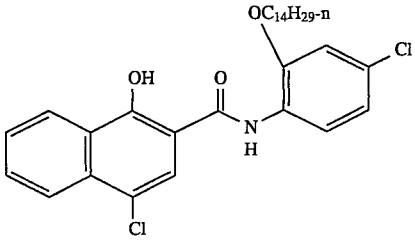

C-15

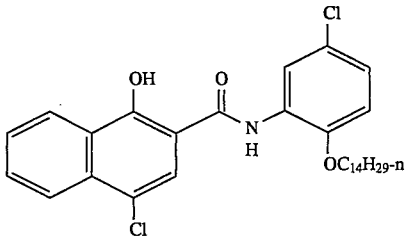

C-16

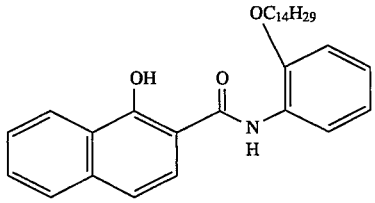

C-17

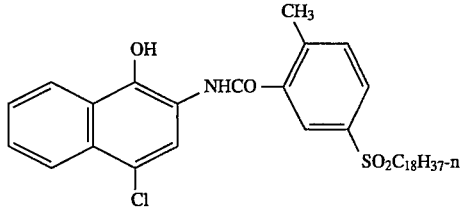

-continued

C-18

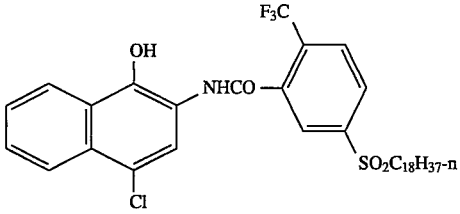

C-19

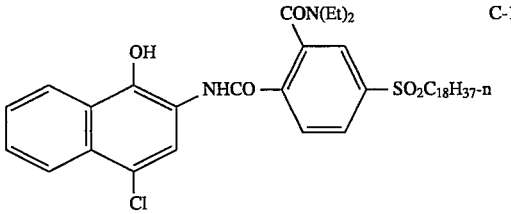

Dispersions of the couplers were prepared in the following manner. In one vessel, coupler M-1 (1.045 g), coupler solvent (1.045 g), and ethyl acetate (3.14 g) were combined and warmed to dissolve. In a second vessel, gelatin (2.66 g), surfactant supplied as Alkanol XC (E. I. duPont Co.) (2.66 g) and water (33.77 g) were combined and passed three times through a Gaulin colloid mill. The ethyl acetate was removed by evaporation. A measured amount of dispersion was mixed with water to bring the gel content to 2.0% and the coupler content to the required level.

The photographic elements were prepared by coating the following layers in the order listed on a resin-coated paper support at the per $m^2$ indicated:

| | |
|---|---|
| 1st Layer | |
| Gelatin | 3.2 g |
| 2nd Layer | |
| Gelatin | 1.6 g |
| Coupler | 0.86 mmol |
| Coupler solvent | weight equivalent to coupler |
| Red sensitized AgCl emulsion | 387 mg Ag (4-equiv coupler) 194 mg Ag (2-equiv coupler) |
| 3rd Layer | |
| Gelatin | 1.3 g |
| 2-(2H-benzotriazol-2-yl)-4,6-bis(1,1-dimethylpropyl)-phenol | 731 mg |
| Tinuvin 326 ™ (Ciba-Geigy) | 129 mg |
| 4th Layer | |
| Gelatin | 1.4 g |
| Bis(vinylsulfonylmethyl) ether | 136 g |

EXPOSURE AND PROCESSING OF PHOTOGRAPHIC ELEMENTS

The photographic elements were given stepwise exposures to red light and processed as follows at 35° C:

| | |
|---|---|
| Developer | 45 sec |
| Bleach-Fix | 45 sec |
| Wash (running water) | 1 min, 30 sec |

The developer and bleach-fix were of the following compositions:

| CD-3 Containing Developer | |
|---|---|
| Water | 700.00 mL |
| Triethanlamine | 12.41 g |
| Optical Brightener (Blankophor REU supplied by Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| KODAK Color Developing Agent CD-3 | 5.00 g |
| 1-Hydroxyethyl-1,1-diphosphonic acid (60%) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make | 1.00 L |
| pH @ 26.7° C. adjusted to 10.04 ± 0.05 | |
| **Bleach-Fix** | |
| Water | 500.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 5.5 ± 0.10 | 0.10 |

For examples of image dyes formed from other developing agents, the coated samples were processed using the above procedure, but substituting the developer solution with one described below:

| CD-2 Containing Developer | |
|---|---|
| Water | 800.00 mL |
| Aminotris (methylenephosphonic acid) pentasodium salt (KODAK Anti-Calcium No. 4) (40% solution) | 1.41 g |
| Sodium sulfite (anhydrous) | 4.35 g |
| Sodium bromide (anhydrous) | 1.72 g |
| Sodium carbonate (monohydrate) | 20.00 g |
| Sodium bisulfate | 1.11 g |
| CD-2 as KODAK, Color Developing Agent CD-2 | 2.95 g |
| Water to make | 1.00 L |
| pH @ 80° F. adjusted to 10.53 ± 0.05 | |
| **CD-4 Containing Developer** | |
| Water | 800.00 mL |
| Potassium carbonate (anhydrous) | 34.30 g |
| Potassium bicarbonate | 2.32 g |
| Sodium sulfite (anhydrous) | 0.38 g |
| Sodium metabisulfite | 2.78 g |
| Potassium iodide | 1.20 mg |
| Sodium bromide | 1.31 g |
| Diethylenetriamine pentaacetic acid pentasodium salt (40% solution) | 8.43 g |
| Hydroxylamine sulfate | 2.41 g |
| KODAK Color Developing Agent CD-4 | 4.52 g |
| Water to make | 1.00 L |
| pH @80° F. adjusted to 10.00±0.05 | |

Developing Agents

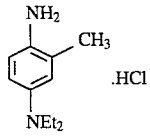

CD-2

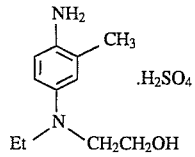

CD-4

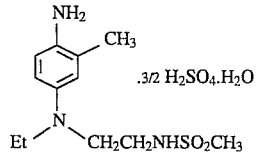

CD-3

Solvents

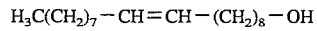

S-1

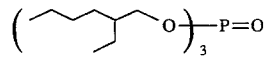

S-2

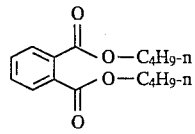

S-3

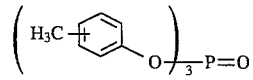

S-4

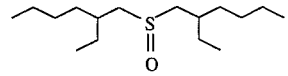

S-5

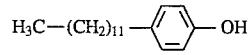

S-6

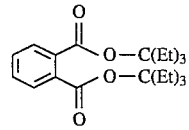

S-7

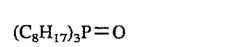

S-8

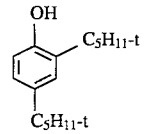

S-9

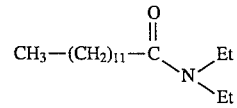

S-10

-continued

S-11

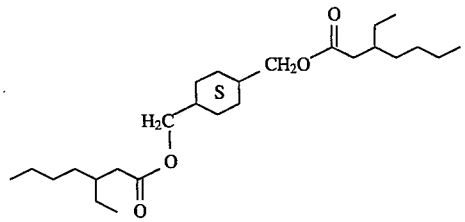

Visible reflectance spectra of a set of exposed and processed strips were measured at a dye density that gave an absorbance near 1.0 at the peak maximum. The spectra were measured from 360 nm to 800 nm on a Hitachi 3410 scanning spectrophotometer using a 0/45 reflectance geometry.

EXAMPLE 1

Cyan dyes were formed upon processing using the CD-3 developer. The following photographic characteristics were determined: λ-MAX (wavelength of maximum absorption) in nm; SS Half Bandwith (the width of the bandwith on the short wavelength side of λ-MAX) in nm.

Values for the various inventive and comparison couplers were determined with the coupler solvents as indicated. Tables 1 and 2 show the results of comparing elements containing orthohalogenated species in accordance with the invention to elements outside the invention.

TABLE I

| | ORTHO-HALOGENATED SPECIES | | | |
|---|---|---|---|---|
| COUPLER | SOL-VENT | TYPE | λ-MAX | SS HALF BANDWIDTH |
| M-7 | S-1 | Invention | 654 | 56 |
| M-15 | S-1 | Invention | 661 | 69 |
| M-28 | S-1 | Invention | 654 | 58 |
| M-29 | S-1 | Invention | 651 | 63 |
| M-31 | S-1 | Invention | 653 | 60 |
| C-7 | S-1 | Comparison | 731 | 106 |
| C-8 | S-1 | Comparison | 673 | 79 |
| C-9 | S-1 | Comparison | 714 | 92 |
| C-10 | S-1 | Comparison | 702 | 100 |
| C-11 | S-1 | Comparison | 708 | 134 |
| C-12 | S-1 | Comparison | 660 | 85 |
| C-13 | S-1 | Comparison | 666 | 97 |

TABLE II

| | ORTHO-HALOGENATED SPECIES | | | |
|---|---|---|---|---|
| COUPLER | SOL-VENT | TYPE | λ-MAX | SS HALF BANDWIDTH |
| M-15 | S-2 | Invention | 663 | 74 |
| M-28 | S-2 | Invention | 667 | 68 |
| M-29 | S-2 | Invention | 673 | 78 |
| M-31 | S-2 | Invention | 673 | 79 |
| C-7 | S-2 | Comparison | 717 | 95 |
| C-8 | S-2 | Comparison | 681 | 76 |
| C-9 | S-2 | Comparison | 716 | 93 |
| C-10 | S-2 | Comparison | 697 | 82 |
| C-11 | S-2 | Comparison | 704 | 86 |
| C-12 | S-2 | Comparison | 713 | 99 |
| C-13 | S-2 | Comparison | 710 | >100 |

The data shows that the inventive couplers provide a formed dye having a wavelength of maximum absorption which is much more desirable than is the case with the comparisons. For both solvents tested, the λ-MAX is shifted to substantially shorter values in or near the desired 630–660nm range. Moreover, SS Bandwidth values for the dyes formed by the inventive couplers are desirably narrower than the comparisons indicating a much lower undesired absorption in the magenta region.

EXAMPLE 2

Samples were prepared and tested as in Example 1 using inventive couplers with an ortho alkoxy substituent. The results of the testing are shown in Tables III and IV. Again, favorable results were obtained for the inventive couplers.

TABLE III

| | ORTHO-ALKOXYLATED SPECIES | | | |
|---|---|---|---|---|
| COUPLER | SOL-VENT | TYPE | λ-MAX | SS HALF BANDWIDTH |
| M-32 | S-1 | Invention | 636 | 49 |
| M-33 | S-1 | Invention | 636 | 49 |
| M-36 | S-1 | Invention | 639 | 50 |
| M-37 | S-1 | Invention | 637 | 51 |
| M-38 | S-1 | Invention | 618 | 69 |
| C-8 | S-1 | Comparison | 673 | 79 |
| C-14 | S-1 | Comparison | 690 | 92 |
| C-15 | S-1 | Comparison | 699 | 101 |
| C-16 | S-1 | Comparison | 690 | 95 |

TABLE IV

| | ORTHO-HALOGENATED SPECIES | | | |
|---|---|---|---|---|
| COUPLER | SOL-VENT | TYPE | λ-MAX | SS HALF BANDWIDTH |
| M-32 | S-2 | Invention | 635 | 53 |
| M-33 | S-2 | Invention | 634 | 52 |
| M-36 | S-2 | Invention | 641 | 59 |
| M-37 | S-2 | Invention | 639 | 57 |
| M-38 | S-2 | Invention | 584 | 46 |
| C-8 | S-2 | Comparison | 681 | 76 |
| C-14 | S-2 | Comparison | 693 | 93 |
| C-15 | S-2 | Comparison | 695 | 93 |
| C-16 | S-2 | Comparison | 690 | 92 |

EXAMPLE 3

Similar results were obtained for the tetrafluorinated species as shown in Tables V and VI.

TABLE V

| | TETRAFLUORINATED SPECIES | | | |
|---|---|---|---|---|
| COUPLER | SOL-VENT | TYPE | λ-MAX | SS HALF BANDWIDTH |
| M-1 | S-1 | Invention | 636 | 50 |
| M-3 | S-1 | Invention | 635 | 49 |
| M-4 | S-1 | Invention | 636 | 55 |
| M-5 | S-1 | Invention | 634 | 51 |
| M-16 | S-1 | Invention | 638 | 56 |
| C-3 | S-1 | Comparison | 705 | 118 |
| C-4 | S-1 | Comparison | 663 | 86 |
| C-8 | S-1 | Comparison | 673 | 79 |
| C-6 | S-1 | Comparison | >800 | >200 |

TABLE VI

| | TETRAFLUORINATED SPECIES | | | |
|---|---|---|---|---|
| COUPLER | SOL-VENT | TYPE | λ-MAX | SS HALF BANDWIDTH |
| M-1 | S-2 | Invention | 637 | 52 |
| M-3 | S-2 | Invention | 637 | 51 |
| M-4 | S-2 | Invention | 644 | 63 |
| M-5 | S-2 | Invention | 658 | 81 |
| M-8 | S-2 | Invention | 642 | 61 |
| M-9 | S-2 | Invention | 640 | 63 |
| M-16 | S-2 | Invention | 639 | 55 |
| C-3 | S-2 | Comparison | 717 | 95 |
| C-8 | S-2 | Comparison | 681 | 76 |
| C-6 | S-2 | Comparison | 720 | 100 |

EXAMPLE 4

Ortho-methylated couplers also show the desired results in Tables VII and VIII.

TABLE VII

| | ORTHO-METHYLATED SPECIES | | | |
|---|---|---|---|---|
| COUPLER | SOL-VENT | TYPE | λ-MAX | SS HALF BANDWIDTH |
| M-39 | S-1 | Invention | 660 | 66 |
| C-17 | S-1 | Comparison | 715 | 92 |

TABLE VIII

| | ORTHO-METHYLATED SPECIES | | | |
|---|---|---|---|---|
| COUPLER | SOL-VENT | TYPE | λ-MAX | SS HALF BANDWIDTH |
| M-39 | S-2 | Invention | 662 | 68 |
| C-17 | S-2 | Comparison | 711 | 93 |
| C-18 | S-2 | Comparison | 682 | 88 |

EXAMPLE 5

Table IX includes data for coatings of coupler M-1 and M-3 with many commonly used coupler solvents. These data demonstrate that the couplers of this invention provide image dyes with similar hue characteristics regardless of the coupler solvent employed in the photographic element. The solvent insensitive nature of the dye absorption curve shape is another advantage of the photographic elements disclosed herein.

TABLE IX

| | Solvent Variations | | | |
|---|---|---|---|---|
| Coupler | Coupler Solvent | $\lambda_{max}$ | SS Half Bandwidth | Type |
| M-1 | S-1 | 640 | 51 | invention |
| M-1 | S-2 | 637 | 52 | invention |
| M-1 | S-3 | 644 | 64 | invention |
| M-1 | S-4 | 648 | 67 | invention |
| M-1 | S-5 | 639 | 55 | invention |
| M-1 | S-6 | 662 | 64 | invention |
| M-1 | S-7 | 644 | 70 | invention |
| M-1 | S-8 | 628 | 42 | invention |
| M-1 | S-9 | 666 | 64 | invention |
| M-1 | S-10 | 636 | 54 | invention |
| M-1 | S-11 | 640 | 65 | invention |
| M-3 | S-2 | 636 | 52 | invention |
| M-3 | S-8 | 630 | 49 | invention |
| M-3 | S-11 | 646 | 69 | invention |

EXAMPLE 6

When coatings of coupler M-1 were treated in a modified process, in which the CD-3 developing solution was replaced with a developing solution containing either CD-2 or CD-4 developing agents (described above), cyan dyes were again formed. The resulting samples were examined spectrophotometrically, and their hue characteristics were found to be similar to that seen for the CD-3 formed dyes. Table X lists the $\lambda_{max}$ and short side half bandwidth for photographic elements processed using CD-2 and CD-4 developing agents.

TABLE X

| | | Other Developing Agents | | | | |
|---|---|---|---|---|---|---|
| | | Agent CD-4 | | Agent CD-2 | | |
| Coup-ler | Coupler Solvent | $\lambda_{max}$ | SS Half Band-width | $\lambda_{max}$ | SS Half Band-width | |
| C-1 | S-3 | 699 | 87 | 695 | 95 | comparison |
| C-2 | S-2 | 669 | 78 | 679 | 91 | comparison |
| M-1 | S-1 | 636 | 50 | 625 | 49 | invention |
| M-1 | S-2 | 626 | 48 | 619 | 43 | invention |
| M-1 | S-3 | 620 | 42 | 599 | 37 | invention |
| M-1 | S-4 | 630 | 57 | 735 | 103 | invention |
| M-1 | S-5 | 629 | 48 | 595 | 30 | invention |
| M-1 | S-6 | 649 | 58 | 636 | 56 | invention |
| M-1 | S-7 | 634 | 47 | 630 | 52 | invention |
| M-1 | S-8 | 628 | 51 | 609 | 44 | invention |
| M-1 | S-9 | 646 | 58 | 634 | 48 | invention |
| M-1 | S-10 | 632 | 56 | 602 | 37 | invention |
| M-1 | S-11 | 637 | 57 | 618 | 47 | invention |

EXAMPLE 7

Image dyes from naphthol-class couplers are known in the art to have a strong sensitivity toward reduction by ferrous ion that is produced within the photographic element during the bleach-fix processing step. The presence of ferrous ion can cause leuco dye formation and the apparent loss of dye density. In order to determine the tendency toward ferrous reduction for the image dyes produced from the couplers of this invention, a set of exposed and D-3 processed coatings were tested for their sensitivity to a ferrous ion solution composed of the following:

| | |
|---|---|
| Water ($N_2$ purged) | 850 mL |
| Ethylenediaminetetraacetic acid (EDTA) | 32.1 g |
| Conc. ammonium hydroxide | 27.5 g |
| Ferrous sulfate heptahydrate | 27.8 g |

The solution was prepared under an atmosphere of nitrogen, and was diluted with water ($N_2$ purged) to a total volume of 1000 mL. The pH was adjusted to 5.00 with conc. ammonium hydroxide. The test strips were placed into a container of the test solution for 5 min at 25° C. with magnetic stirring and agitation from $N_2$ inlets. The strips were then washed in running water for 5 min at 25° C. The change in status-A red density was determined (from an original density of 1.0), and these values are listed in Table X.

Table X shows that none of the photographic elements containing the couplers of the present invention share the sensitivity to ferrous ion reduction that is seen for C-2. This resistance toward reduction by ferrous ion is another advantage of the photographic elements of this invention, providing superior color reproduction.

TABLE XI

| | Dye Density Change Due to Exposure to Ferrous Test Solution | | |
|---|---|---|---|
| Coupler | Coupler Solvent | Ferrous % Change from D = 1.0 | |
| C-2 | S-2 | −87 | comparison |
| M-1 | S-1 | −21 | invention |
| M-1 | S-2 | −34 | invention |
| M-1 | S-3 | −31 | invention |
| M-1 | S-4 | −25 | invention |
| M-1 | S-5 | −39 | invention |
| M-1 | S-6 | −13 | invention |
| M-1 | S-7 | −30 | invention |
| M-1 | S-8 | −15 | invention |
| M-1 | S-9 | −7 | invention |
| M-1 | S-10 | −20 | invention |
| M-1 | S-11 | −36 | invention |
| M-3 | S-2 | −34 | invention |
| M-3 | S-8 | −28 | invention |
| M-3 | S-11 | −23 | invention |
| M-4 | S-1 | −19 | invention |
| M-4 | S-2 | −52 | invention |
| M-5 | S-1 | −17 | invention |
| M-10 | S-2 | −33 | invention |
| M-11 | S-2 | −35 | invention |
| M-15 | S-1 | −18 | invention |
| M-15 | S-2 | −31 | invention |

What is claimed is:

1. A photographic element comprising a red light sensitive silver halide emulsion layer having associated therewith a cyan dye-forming coupler dispersed in an organic solvent, the coupler having the formula:

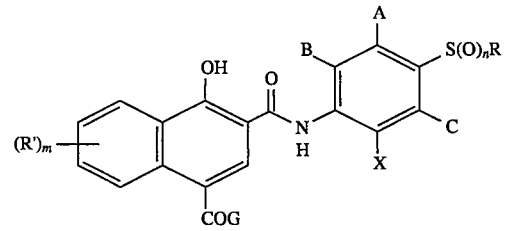

wherein

A, B, and C are hydrogen or fluoride;

X is selected from the group consisting of halogen, alkoxy and methyl groups;

R is an aromatic or aliphatic group and n is 1 or 2;

R' is a substituent group and m is from 0 to 4;

COG is hydrogen or a coupling-off group capable of being split-off by an oxidized color developer; and wherein the substituent groups X, R, and R' are selected so as to ballast the coupler and keep it from wandering within the photographic elements.

2. The element of claim 1 wherein R is selected from the group consisting of alkyl and phenyl groups.

3. The element of claim 1 wherein R includes an alkyl group of at least 8 carbon atoms.

4. The element of claim 1 where n is 1.

5. The element of claim 1 wherein n is 2.

6. The element of claim 1 wherein X is halogen.

7. The element of claim 1 wherein X is an alkoxy group.

8. The element of claim 1 wherein X is a methyl group.

9. The element of claim 1 wherein X is halogen, alkoxy, or methyl and B is fluorine.

10. The element of claim 1 wherein A, B, C, and X are fluorine.

11. The element of claim 1 wherein COG is selected from the group consisting of hydrogen, chloride, a phenoxy group, an alkoxy group, a heterocyclicoxy group, a phenylthio group, and a heterocyclic group.

12. A process for forming an image after exposure of an element as described in claim 1 to light and then contacting the element with a color developing agent.

* * * * *